United States Patent [19]

Cheng

[11] Patent Number: 4,598,524

[45] Date of Patent: Jul. 8, 1986

[54] FOUNDATION OF THE HANDRAIL

[76] Inventor: Wen-Chang Cheng, 4th Floor, No. 3, Lane 14, Szu Wei Road, Taipei, Taiwan, 106

[21] Appl. No.: 755,895

[22] Filed: Jul. 17, 1985

[51] Int. Cl.[4] ..... E04F 11/00

[52] U.S. Cl. ..... 52/708; 52/189; 52/182; 52/702; 248/544; 248/534

[58] Field of Search ..... 52/182, 184, 185, 187, 52/189, 190, 702, 296, 708; 256/DIG. 6, 20; 182/87; 248/544, 534

[56] References Cited

U.S. PATENT DOCUMENTS

| | | | |
|---|---|---|---|
| 796,433 | 8/1905 | Kahn | 182/87 |
| 858,838 | 7/1907 | Tuteur | 52/702 |
| 1,385,765 | 7/1921 | Wells | 52/702 |
| 3,596,426 | 8/1971 | Loov | 52/184 |
| 4,353,664 | 10/1982 | Gilb | 52/702 |

FOREIGN PATENT DOCUMENTS

| | | | |
|---|---|---|---|
| 665058 | 10/1965 | Belgium | 52/184 |
| 3028002 | 9/1982 | Fed. Rep. of Germany | 52/182 |
| 401056 | 4/1969 | U.S.S.R. | 52/296 |

*Primary Examiner*—Henry E. Raduazo

[57] ABSTRACT

A device in U-shape has two plates, one lower one upper, by which the vertical bar of a handrail can be welded. It can increase the stability of the handrail on the one hand, and the plates can be adjusted to match the location of the lower end of the vertical bar on the other hand.

4 Claims, 10 Drawing Figures

FOUNDATION OF THE HANDRAIL

BACKGROUND OF THE INVENTION

A novel device used as the foundation of the handrail or balustrade is invented and designed. The present invention is an open case and can be preset in the concrete block where a handrail is desired, such as the staircase, the verandah, the porch or the balcony.

There is no foundation of the handrail in the conventional method of Construction. The vertical bars of the rail are simply set into the holes preserved beforehand in the concrete. A vertical bar is welded at only one point with the steel bar in the concrete, and then the hole is filled with the cement mortar. Thus the whole frame of the handrail will not be stable when it is constructed in the simple way as described above. Further more, the positions of the preserved holes may not be exactly correct for the vertical bars which are pre-constructed with the rail in the ironworks. Then it will cause some troubles to the construction of the building.

SUMMARY

The present invention is a "U" shaped case with one side left open (top view). There are two plates, one of them is horizontally welded to the side walls of the case at the bottom and the other one vertically welded at the top. The vertical bar is then welded to these two plates at two points on the bars. In addition, there are two anchors are attached to the case. When the whole things set in the concrete, they will be much more stable than the handrail as constructed in the conventional way as previously described.

The object of the present invention is to provide a way of construction of handrail by which the handrail can be erected with high stability. The other object is to provide a room in which the two plates can be adjusted to match the lower end of the vertical bar.

BRIEF DESCRIPTION OF THE DRAWINGS

FIG. 1. Side view of the stairway with the present invention inset in.

The names with the designated numbers of the members showing in the figures are listed below.

1. Present invention.
2. Vertical bars.
3. Handrail.
4. Stairway.
5. Anchors.
6. Bottom plate.
7. Case walls.
8. Concrete form board.
9. Nails.

10. Welding.
11. Top plate.

DESCRIPTION OF THE PREFERRED EMBODIMENT

In top view, the present invention 1 is a "U" shaped case with one side open (see FIGS. 4, 5, 6, 8, and 9). So three walls 7 form the case in "U" shape. Say, the opened side is the front, then two anchors 5 are fixed to the side walls backward (see FIGS. 2, 4, 5, 6, 7, 8, 9, and 10). A bottom plate 6 is horizontally fixed to the two side case walls 7 (see FIGS. 2, 5, 6, 7, and 10). The bottom plate 6 is smaller the bottom area of the case, so that the concrete above the bottom plate 6 (i.e. inside the case) and below the bottom plate 6 (i.e. outside the case) can be consolidated together.

Figure 1:
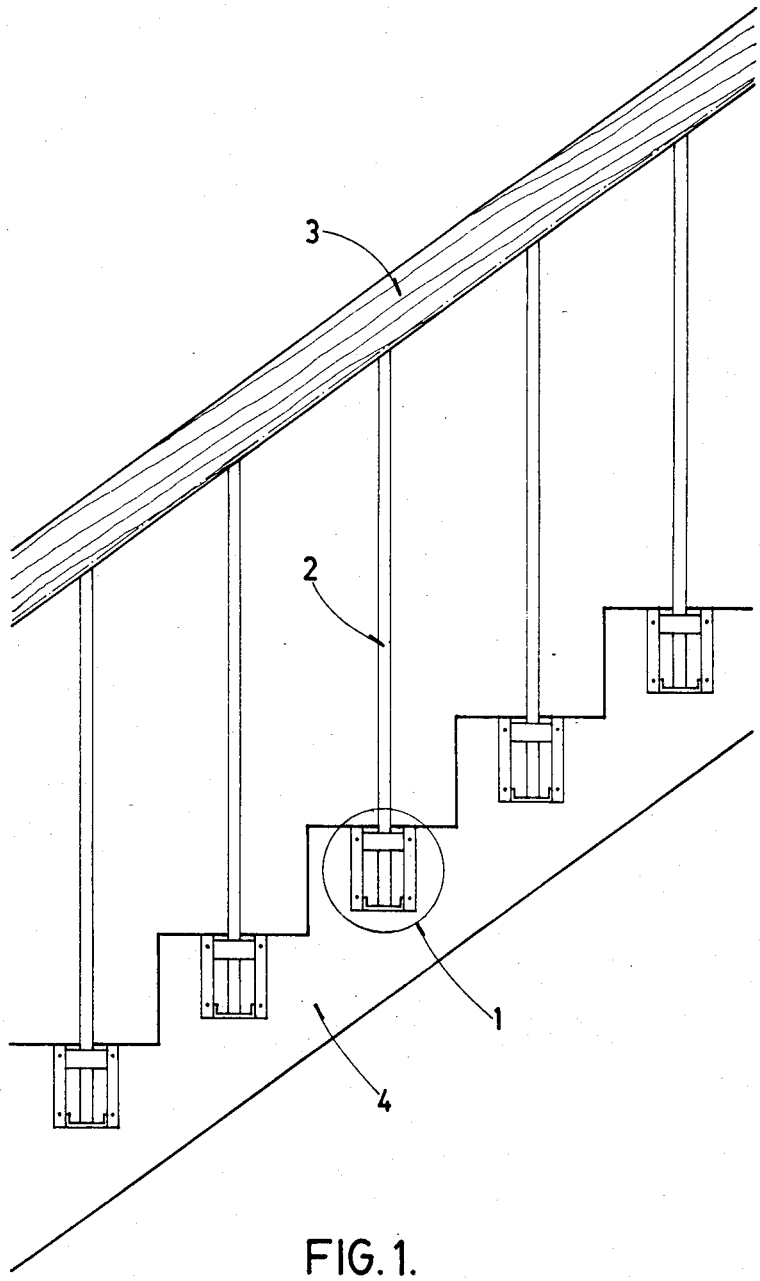
Figure 4:
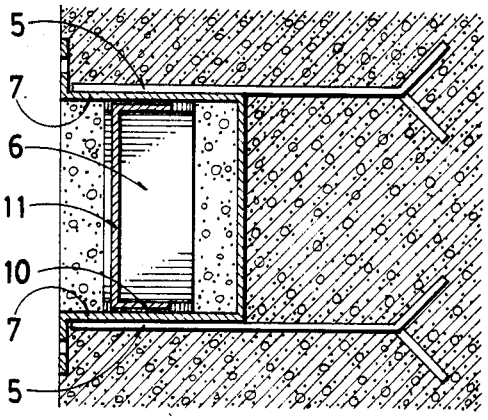
FIG. 4. Top view of the present invention.
Figure 3:
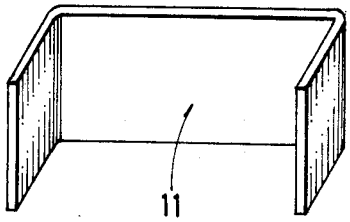
FIG. 3. Perspective view of the top plate.
Figure 2:
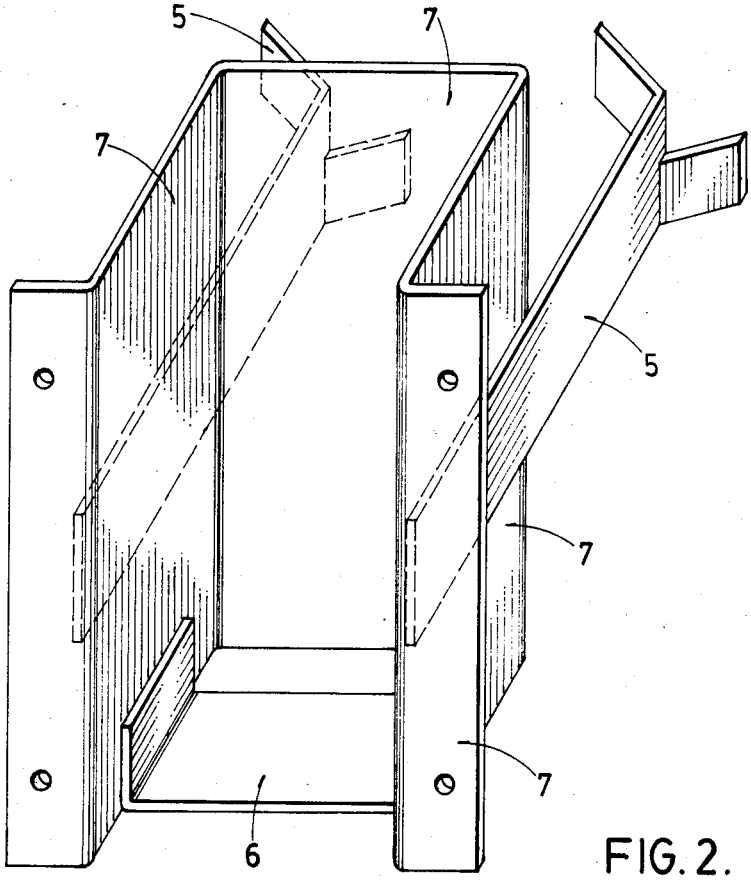
FIG. 2. Perspective view of the present invention with the top plate removed.
Figure 5:
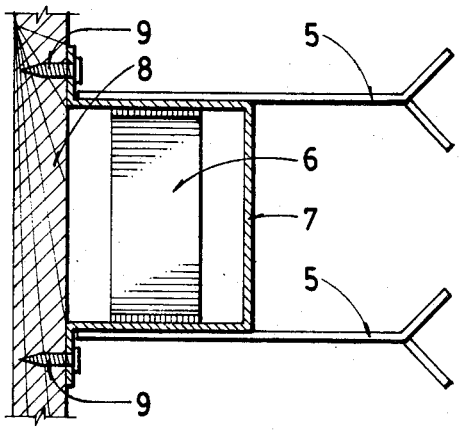
FIG. 5. Top view of the present invention attached to concrete form board.
Figure 6:
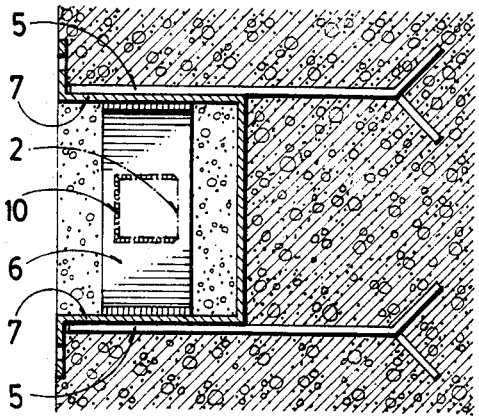
FIG. 6. Top view showing the welding of the lower end of the vertical bar to the bottom plate.
Figure 7:
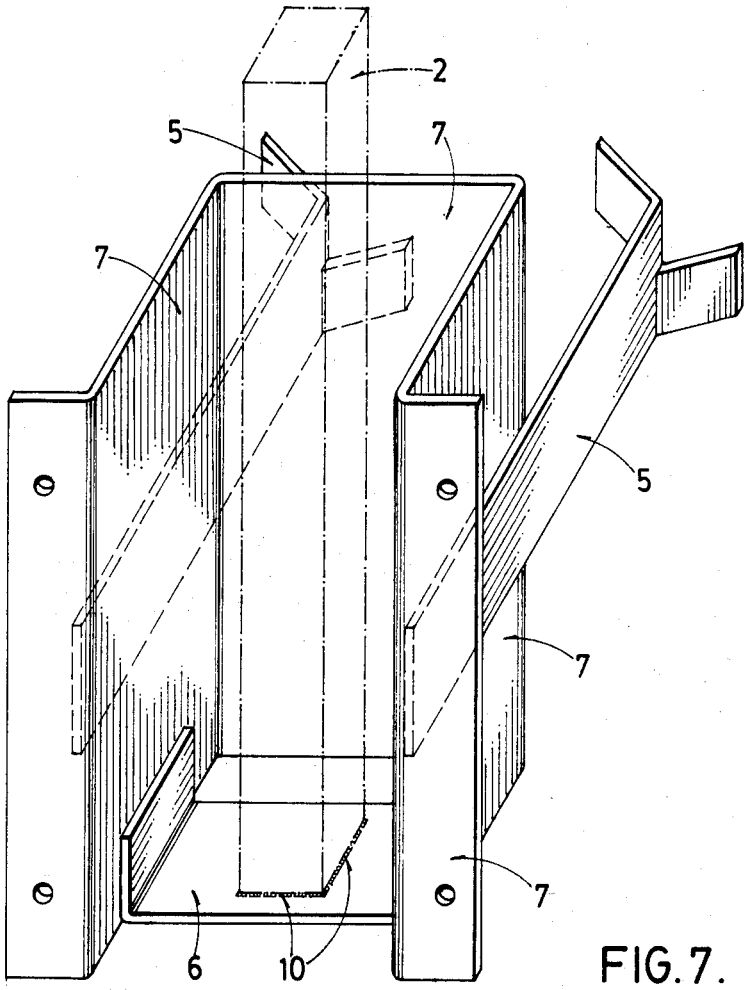
FIG. 7. Perspective view showing the welding of the lower end of the vertical bar to the bottom plate.
Figure 8:
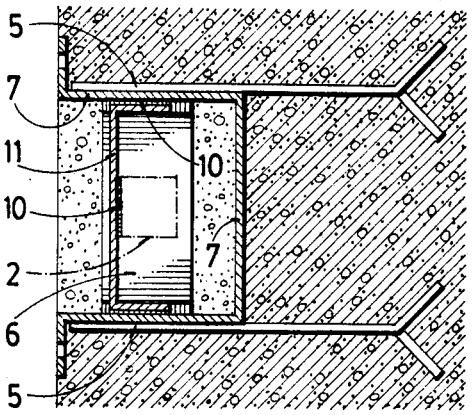
FIG. 8. Top view showing one way of welding of the top plate to the vertical bar.
Figure 9:
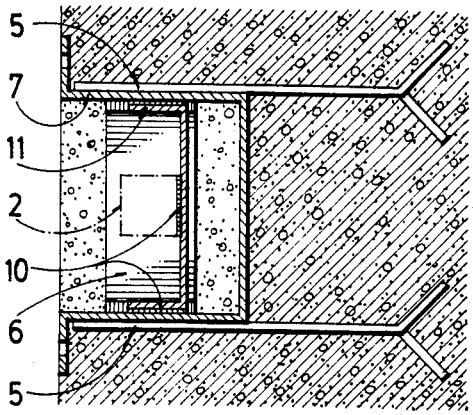
FIG. 9. Top view showing another way of welding of the top plate to the vertical bar.
Figure 10:
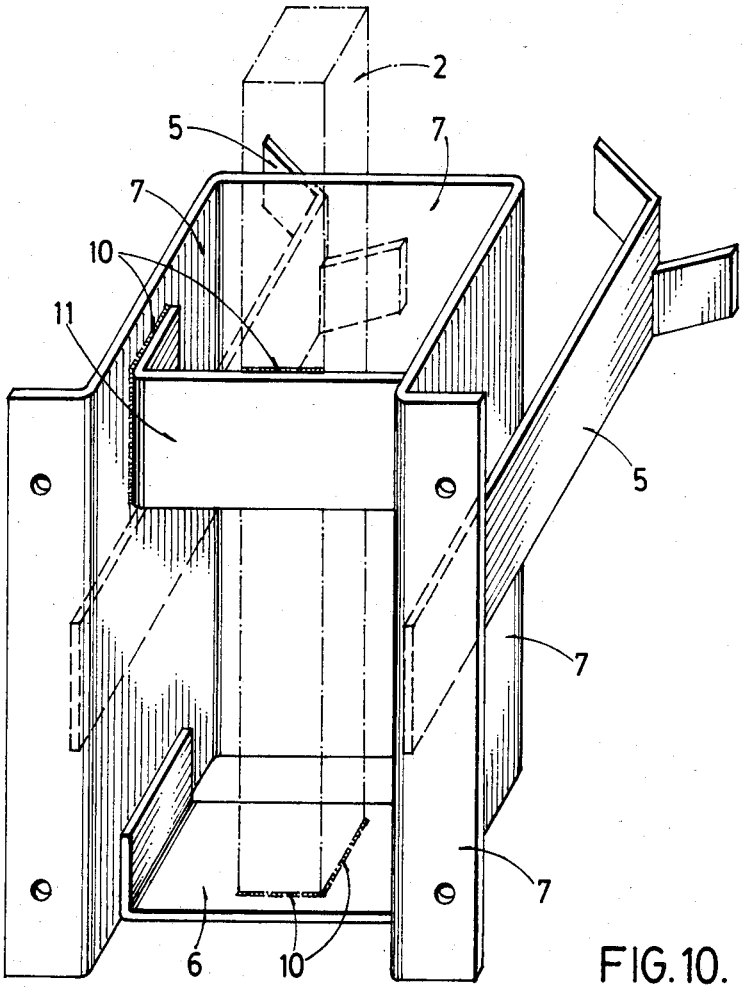
FIG. 10. Perspective view showing the present invention assembled together with the vertical bars welded to the two plates.

Now the present invention 1 can be inset at its proper position in the stairway 4 (see FIG. 1) and fixed to the concrete form board 8 with nails 9 (see FIG. 5). The concrete of the stairway 4 can be now made. The whole frame of the handrail 3 can be pre-constructed in the ironworks and then erected on the stairway 4 with the lower ends of the vertical bars 2 within the case walls 7 (see FIGS. 1, 7, and 10). The lower ends of the vertical bars 2 can be welded on to any place of the bottom plates 6 (see FIGS. 1, 6, 7, and 10). A top plate 11 for each vertical bar 2 can be applied and vertically welded to the vertical bar 2 and also to the two side case walls 7. There are two different ways of welding of the top plate 11 to the vertical bar 2: one to the left of the vertical bar 2, one to the right of the vertical bar 2 (see FIGS. 8, and 9 respectively). The top plate 11 is welded at the top of the two side case walls 7 in both ways (see FIG. 10). The concrete within the case walls 7 can be now made. Therefore the vertical bars 2 are firmly buried in the concrete. So that the whole frame of the handrail 3 is stably constructed.

The weldings 10 in the present invention are shown in FIGS. 6, 7, 8, 9, and 10.

If the present invention 1 should be situated a little distance apart from the concrete form board 8 (see FIG. 5), a plank (not shown in the figure) can be used in between the concrete form board 8 and the present invention 1.

I claim:

1. A device for use as support foundation for a handrail having vertical bars said device comprising:

a. a U-shaped case having two side walls, a base and an open side opposite said base said case having open upper and lower areas dimentioned to receive a said vertical bar;

b. two anchors, each being attached to one of said side walls and extending beyond said base in a direction opposite to said open side;

c. a bottom plate positioned to receive a said vertical bar in face-to-face contact and to be welded thereto, and d. a top plate adapted to fit between said two sidewalls and be welded to both the side walls and the said vertical bar.

2. A device as in claim 1 wherein the open upper and lower areas of said U-shaped case are larger than the cross section of said vertical bar whereby the position of the vertical bar in said U-shaped case may be varied.

3. A device as in claim 1 wherein said bottom plate has a surface area smaller than the lower area defined by said U-shaped case.

4. A device as in claim 2 whereby the large open area of said U-shaped case permits the placement of concrete in said U-shaped case after said vertical bar has been welded in place.

* * * * *